US009874118B2

(12) United States Patent
Kajita et al.

(10) Patent No.: US 9,874,118 B2
(45) Date of Patent: Jan. 23, 2018

(54) VALVE OPENING/CLOSING TIMING CONTROL DEVICE

(71) Applicant: AISIN SEIKI KABUSHIKI KAISHA, Kariya-shi, Aichi (JP)

(72) Inventors: Tomohiro Kajita, Anjo (JP); Yuji Noguchi, Obu (JP); Takeo Asahi, Kariya (JP); Hiroyuki Hamasaki, Obu (JP); Kenji Ikeda, Gotenba (JP); Yoshiaki Iguchi, Toyohashi (JP)

(73) Assignee: AISIN SEIKI KABUSHIKI KAISHA, Kariya-shi, Aichi (JP)

( * ) Notice: Subject to any disclaimer, the term of this patent is extended or adjusted under 35 U.S.C. 154(b) by 5 days.

(21) Appl. No.: 15/033,730

(22) PCT Filed: Nov. 18, 2014

(86) PCT No.: PCT/JP2014/080424

§ 371 (c)(1),
(2) Date: May 2, 2016

(87) PCT Pub. No.: WO2015/079963

PCT Pub. Date: Jun. 4, 2015

(65) Prior Publication Data

US 2016/0237862 A1 Aug. 18, 2016

(30) Foreign Application Priority Data

Nov. 29, 2013 (JP) ..... 2013-248165

(51) Int. Cl.
*F01L 1/34* (2006.01)
*F01L 1/344* (2006.01)
(Continued)

(52) U.S. Cl.
CPC ..... *F01L 1/3442* (2013.01); *F01L 1/047* (2013.01); *F01L 9/02* (2013.01);
(Continued)

(58) Field of Classification Search
CPC . F01L 1/3442; F01L 9/02; F01L 1/047; F01L 2001/34446; F01L 2001/34423; F01L 2103/00
See application file for complete search history.

(56) References Cited

U.S. PATENT DOCUMENTS 8,910,604 B2 12/2014 Adachi et al.
8,910,605 B2 12/2014 Adachi et al.
(Continued)

FOREIGN PATENT DOCUMENTS

DE 10134320 A1 1/2003
JP 2000-161028 A 6/2000
(Continued)

OTHER PUBLICATIONS

International Search Report (PCT/ISA/210) dated Feb. 17, 2015, by the Japanese Patent Office as the International Searching Authority for International Application No. PCT/JP2014/080424.
(Continued)

*Primary Examiner* — Zelalem Eshete
(74) *Attorney, Agent, or Firm* — Buchanan Ingersoll & Rooney PC

(57) ABSTRACT

The valve opening/closing timing control device includes: an advancing chamber and a retarding chamber that are formed by partitioning a fluid pressure chamber that is formed between a driving rotating body and a driven rotating body that is located on an inner circumference side of the driving rotating body so as to be relatively rotatable, with a partitioning portion that is provided on an outer circumference side of the driven rotating body; an advancing channel that is in communication with the advancing chamber; and a retarding channel that is in communication with the retarding chamber. The driven rotating body has a first member and a second member, and the advancing channel and the retarding channel are formed to penetrate through a boundary between the first member and the second member after the first member and the second member have been installed.

3 Claims, 5 Drawing Sheets

(51) Int. Cl.
*F01L 1/047* (2006.01)
*F01L 9/02* (2006.01)

(52) U.S. Cl.
CPC ..... *F01L 2001/34423* (2013.01); *F01L 2001/34446* (2013.01); *F01L 2103/00* (2013.01)

(56) References Cited

U.S. PATENT DOCUMENTS

| | | | |
|---|---|---|---|
| 9,267,401 | B2 | 2/2016 | Noguchi et al. |
| 2003/0037741 | A1 | 2/2003 | Kohrs |
| 2012/0060779 | A1 | 3/2012 | Adachi et al. |
| 2012/0132160 | A1 | 5/2012 | Malen et al. |
| 2015/0096513 | A1 | 4/2015 | Noguchi et al. |

FOREIGN PATENT DOCUMENTS

| | | | |
|---|---|---|---|
| JP | 2012-057578 | A | 3/2012 |
| JP | 2012-172558 | A | 9/2012 |
| JP | 2012-172559 | A | 9/2012 |
| WO | 2010/128976 | A1 | 11/2010 |
| WO | WO 2014/038267 | A1 | 3/2014 |

OTHER PUBLICATIONS

Written Opinion (PCT/ISA/237) dated Feb. 17, 2015, by the Japanese Patent Office as the International Searching Authority for International Application No. PCT/JP2014/080424.

VALVE OPENING/CLOSING TIMING CONTROL DEVICE

TECHNICAL FIELD

The present invention relates to a valve opening/closing timing control device that includes: a driving rotating body that rotates in synchronization with a crankshaft of an internal combustion engine; and a driven rotating body that rotates in synchronization with a camshaft for opening/closing a valve of the internal combustion engine.

BACKGROUND ART

In order to improve the fuel efficiency of an internal combustion engine (hereinafter referred to as "engine"), a valve opening/closing timing control device that controls the timing of opening/closing either one or both of an intake valve and an exhaust valve is conventionally used. A valve opening/closing timing control device of this type controls the opening/closing timing by changing the rotation phase of a driving rotating body that rotates in synchronization with a crankshaft, and a driven rotating body that rotates in synchronization with a camshaft, relative to each other. The driven rotating body of such a valve opening/closing timing control device is rotated along with the rotation of the driving rotating body, and also transmits rotative power to the camshaft. Therefore, studies have been performed to reduce the weight while maintaining the strength.

The valve opening/closing timing control device disclosed in Patent Document 1 has: a press-fitted portion that is press-fitted into a recessed portion that is formed in a driven rotating body; and is provided with a coupling member that couples the driven rotating body and a camshaft to each other. Such a press-fitted portion: has a plurality of fitting portions that are located at intervals along the rotation direction, and that engage with the inner circumferential surface of the recessed portion; and is configured such that the center line of at least one fitting portion orientated in the radial direction, out of the plurality of fitting portions, does not overlap partitioning portions in the radial direction.

The valve opening/closing timing control device disclosed in Patent Document 2 is provided with a coupling member that couples a driven rotating body and a camshaft to each other. The coupling member has: a flange portion that is inserted into a recessed portion formed in a driven rotating body; and a shaft portion that is inserted into a through hole that is formed in a camshaft-side wall member of a driving rotating body, and the outer diameter of the flange portion is set to be greater than the outer diameter of the shaft portion, and the flange portion is located between the driven rotating body and the wall member.

In the valve opening/closing timing control devices disclosed in Patent Documents 1 and 2, the driven rotating body is divided into a coupling member that requires strength and a rotating body that does not require strength, and the coupling member that requires strength is formed with a high-strength material. The coupling member and the rotating body are in contact with each other in a discontinuous manner, and the connection is realized with press-in force or the fastening force of a cam bolt. Oil channels are formed in the coupling member and the rotating body, and these oil channels are formed when the coupling member and the rotating body are in the state of being separated from each other, and are thereafter connected by positioning.

The valve timing adjustment device disclosed in Patent Document 3 includes: a vane rotor having a vane member that is housed in an accommodation chamber formed within a housing member so as to be rotatable relative to the housing member only within a predetermined angular range, and that partitions the accommodation chamber into an advancing chamber and a retarding chamber; and a boss portion that is formed with a material that is different from the material of the vane rotor, is embedded in the vane rotor, and is coupled to the other of a driving shaft and a driven shaft.

In the valve timing adjustment device disclosed in Patent Document 3, a boss portion made of an iron-based material is formed to envelop the vane rotor made of an aluminum-based material, by insert casting. The housing and the vane member are designed to ensure optimal clearance and air-tightness of a fan-shaped space, and are reduced in weight in order to achieve a lightweight device. The oil channels that bring the boss portion and the vane rotor into communication with each other are individually formed when the boss portion and the vane rotor are in the state of being separated from each other, by positioning the oil hole of the boss portion and the oil hole of the vane rotor relative to each other.

RELATED ART DOCUMENTS

Patent Document

Patent Document 1: JP 2012-172558A
Patent Document 2: JP 2012-172559A
Patent Document 3: JP 2000-161028A

SUMMARY

Problem to be Solved by Invention

According to the technologies disclosed in Patent Documents 1 to 3, the driven rotating body is divided into the coupling member and the rotating body, and their oil channels are individually formed. Therefore, it is necessary to perform accurate positioning in order to bring the respective oil channels into communication with each other after the coupling member and the rotating body have been installed. For this reason, each part requires a high degree of dimensional accuracy, which is a cause of an increase in the cost, and also complicates the manufacturing processes. Also, the addition of a predetermined shape only for the sake of such positioning is a cause of an increase in the cost and the weight. Also, after the coupling member and the rotating body have been installed, if, for example, their oil channels are displaced from each other, the cross-sectional area of the oil channel decreases, and the amount of hydraulic oil, which drives the valve opening/closing timing control device, that flows decreases, and the response speed decreases when the driven rotating body is driven relative to the driving rotating body. Furthermore, when oil channels are individually formed for each part, if the traces of processing on the respective inner circumferential surfaces of the oil channels are not uniform, resistance against the circulating hydraulic oil increases, and the aforementioned response speed decreases in this case as well.

In light of the above-described problems, the present invention aims to provide a valve opening/closing timing control device in which oil channels are formed with a high degree of accuracy without an increase in the cost even if the driven rotating body is configured with a plurality of separate parts.

Solution

A characteristic configuration of a valve opening/closing timing control device according to one aspect of the present invention for achieving the above-described aim lies in including: a driving rotating body that rotates in synchronization with a crankshaft of an internal combustion engine; a driven rotating body that is located on an inner circumference side of the driving rotating body coaxially with a rotational axis of the driving rotating body so as to be relatively rotatable, and that rotates in synchronization with a camshaft for opening/closing a valve of the internal combustion engine; a fluid pressure chamber that is formed between the driving rotating body and the driven rotating body; an advancing chamber and a retarding chamber that are formed by partitioning the fluid pressure chamber with a partitioning portion that is provided on an outer circumference side of the driven rotating body; an advancing channel that is formed in the driven rotating body and is in communication with the advancing chamber; a retarding channel that is formed in the driven rotating body and is in communication with the retarding chamber; and a phase control unit that controls a rotation phase of the driven rotating body relative to the driving rotating body by controlling supply and discharge of a pressurized fluid that circulates through the advancing channel and the retarding channel, and that the driven rotating body has: a first member that is cylindrical and is provided with the partitioning portion; and a second member that is cylindrical, has a rotational axis that is the same as a rotational axis of the first member, and has a portion that overlaps an inner side of the first member at least in a radial direction of the first member, out of the radial direction of the first member and an axial direction, and the advancing channel and the retarding channel are formed to penetrate through a boundary between the first member and the second member after the first member and the second member have been installed.

With this characteristic configuration, the advancing channel and the retarding channel are formed to penetrate through the boundary between the first member and the second member after the first member and the second member have been installed and integrated into one piece, and therefore the first member and the second member can be formed in one manufacturing process. Therefore, only one jig is needed to form the advancing channel and the retarding channel, and it is possible to reduce the manufacturing cost. Also, misalignment of the first member and the second member does not occur thought the first member and the second member, and therefore it is possible to form the advancing channel and the retarding channel with a high degree of accuracy. Also, it is possible to form the advancing channel and the retarding channel that each have an inner circumferential surface that is continuous between the first member and the second member, and therefore it is possible to maintain channel resistance against hydraulic oil to be constant when the hydraulic oil circulates through the advancing channel and the retarding channel. Therefore, when rotating the driven rotating body relative to the driving rotating body, it is possible to prevent the response speed from decreasing.

It is preferable that the advancing channel and the retarding channel are provided with an intrusive portion where the first member or the second member intrudes into the other of the first member and the second member from the boundary.

With this configuration, the advancing channel and the retarding channel are provided with the intrusive portion that is formed at the boundary so as to intrude from one of the first member and the second member to the other, and therefore it is possible to reinforce the connection strength at the boundary. Therefore, when hydraulic oil circulates through the advancing channel and the retarding channel, it is possible to prevent the hydraulic oil from leaking from the boundary between the first member and the second member.

Also, it is preferable that the advancing channel and the retarding channel penetrate through the driven rotating body in the radial direction of the first member, and are open to a recessed portion that is provided in an outer circumferential surface of the driven rotating body.

With this configuration, for example when the advancing channel and the retarding channel are formed by boring processing using a drill, the boring processing can be performed after setting the drill in the recessed portion. Therefore, it is possible to prevent axial misalignment from occurring due to the rotation of the drill, particularly at the initial stage of rotation, and it is possible to increase the processing accuracy regarding the advancing channel and the retarding channel.

Also, it is preferable that the second member overlaps the first member in the axial direction, at least the advancing channel or the retarding channel has: a first part that extends in the radial direction of the first member; and a second part that extends along the axial direction of the first member and the second member, and the first part and the second part are in communication with each other.

With this configuration, even if at least the advancing channel or the retarding channel is formed so as not to penetrate through the inner rotor, the advancing channel and the retarding channel can be formed to penetrate through the boundary between the first member and the second member. Therefore, even in such a case, it is possible to form the advancing channel and the retarding channel in one process, and it is possible to form the advancing channel and the retarding channel with a high degree of accuracy at low cost and achieve the functions and effects that are the same as those described above.

EMBODIMENT

Figure 1:
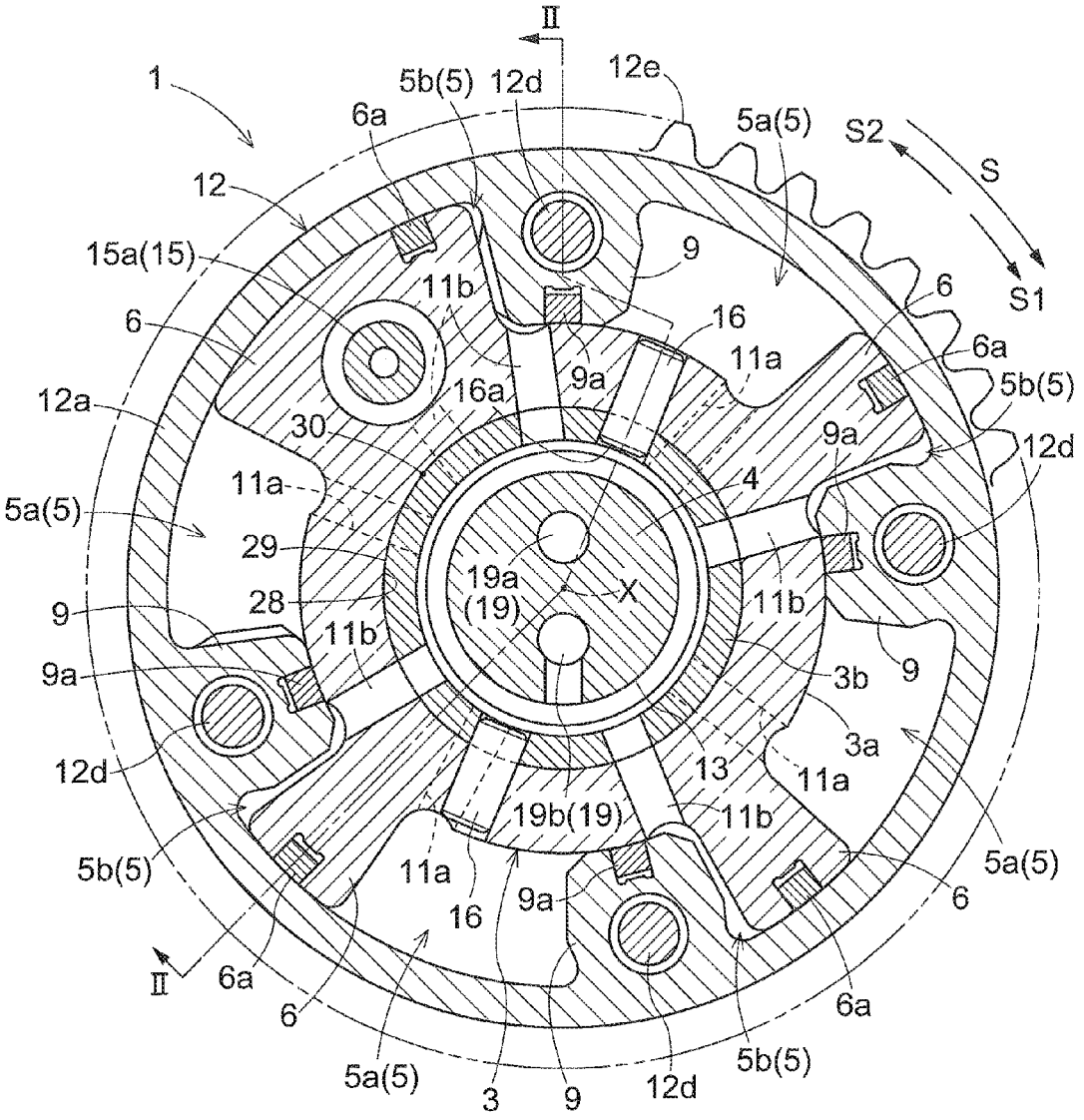
FIG. 1 is a cross-sectional view of a valve opening/closing timing control device.
Figure 2:
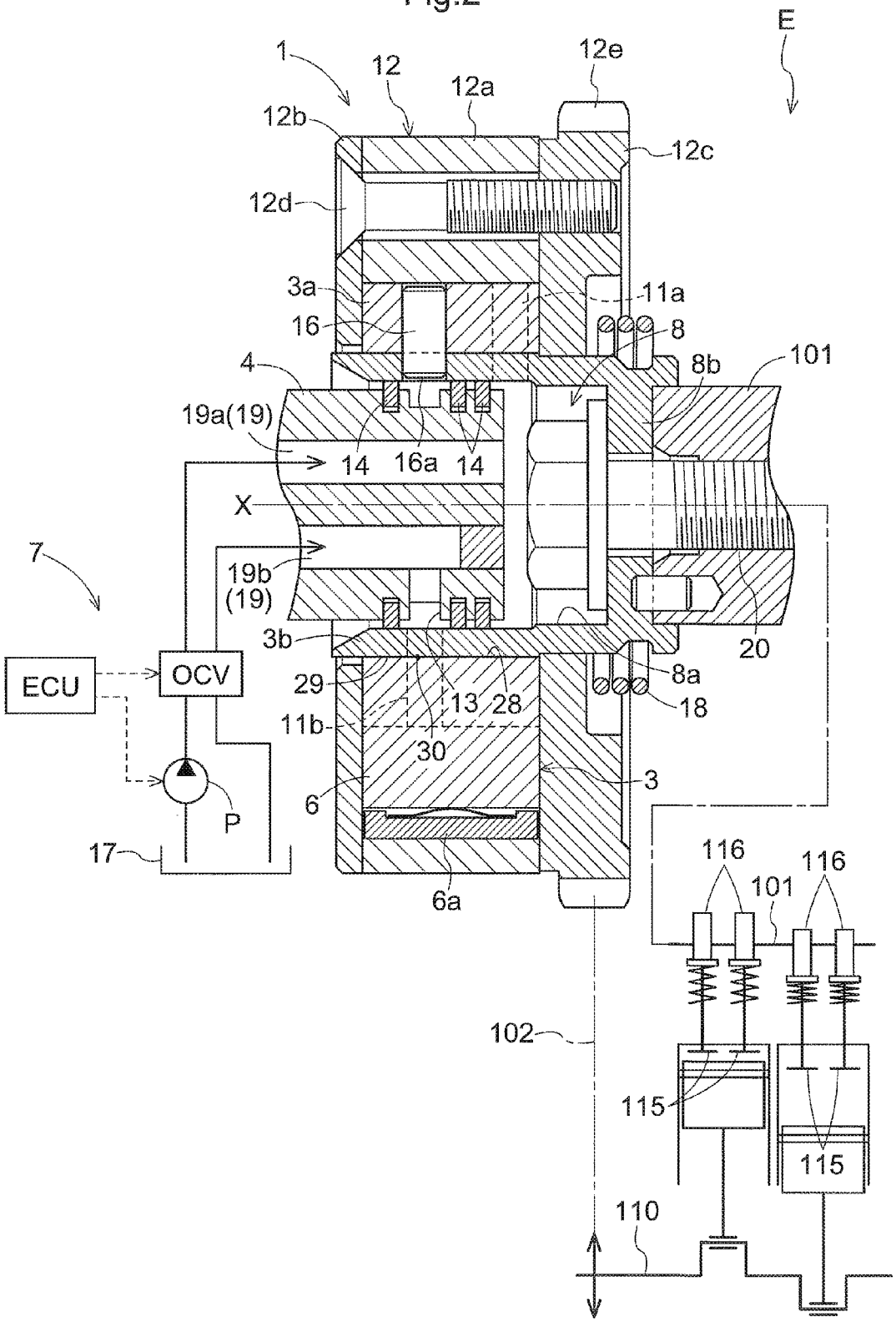
FIG. 2 is a cross-sectional view along a line II-II in FIG. 1.

In a valve opening/closing timing control device according to one aspect of the present invention, a driven rotating body has a first member and a second member, and oil channels of the driven rotating body are formed with a high degree of accuracy at low cost. The following provides a detailed description of a valve opening/closing timing control device 1 according to an embodiment. FIG. 1 is a cross-sectional view of the valve opening/closing timing control device 1 according to the present embodiment, seen in an axial direction. FIG. 2 is a cross-sectional view along a line II-II in FIG. 1. The valve opening/closing timing control device 1 is mounted on a vehicle that is provided with an engine serving as a power source, which is an internal combustion engine E, or a hybrid vehicle that is provided with a power source that includes an engine and an electrical motor.

The valve opening/closing timing control device 1 includes: a housing 12 serving as a driving rotating body; and an inner rotor 3 serving as a driven rotating member. The housing 12 rotates in synchronization with a crankshaft 110 of the internal combustion engine E. The inner rotor 3 is located on the inner circumference side of the housing 12 coaxially with a rotational axis X of the housing 12 so as to be relatively rotatable, and rotates in synchronization with a camshaft 101 of the internal combustion engine E. In the present embodiment, the valve opening/closing timing control device 1 controls opening/closing timing of an intake valve 115 by setting the relative rotation phase (relative rotation angle) of the housing 12 and the inner rotor 3 about the rotational axis X.

The housing 12 includes: an outer rotor 12*a* having a cylindrical outer circumferential shape; a front plate 12*b* that is located on the front side of the outer rotor 12*a;* and a rear plate 12*c* that is located on the rear side of the outer rotor 12*a*, which are fixed to each other with coupling bolts 12*d* and are integrated into one piece. The outer rotor 12*a* and the front plate 12*b* are formed with an aluminum-based material such as an aluminum alloy, and the rear plate 12*c* is formed with an iron-based material.

A sprocket 12*e* made of an iron-based material is provided on the outer circumference side of the rear plate 12*c*, coaxially with the rear plate 12*c*. A power transmission member 102 such as a timing chain or a timing belt is wound around the sprocket 12*e* and a sprocket that is attached to the crankshaft 110. Consequently, the housing 12 rotates in the direction indicated by an arrow S as the internal combustion engine E is driven. In the present embodiment, the inner rotor 3 is fixed to a tip portion of the camshaft 101. The inner rotor 3 is driven to rotate in a rotation direction S along with the rotation of the housing 12, and thus the camshaft 101 rotates, and a cam 116 provided on the camshaft 101 presses the intake valve 115 of the internal combustion engine E downward and opens the valve.

In the present embodiment, the inner rotor 3 is provided with a recessed portion 8 that is coaxial with the rotational axis X and that has a cylindrical inner circumferential surface 8*a*. The inner rotor 3 and the camshaft 101 are fastened to each other by screwing a bolt 20, which has been inserted into a bottom plate portion 8*b* of the recessed portion 8, into the camshaft 101 coaxially therewith. Also, a torsion coil spring 18 that biases the rotation phase of the inner rotor 3 relative to the housing 12 toward the advance side is attached so as to span the inner rotor 3 and the rear plate 12*c*.

A plurality of protruding portions 9 (four in the present embodiment) that protrude inward in the radial direction are formed on the inner circumference side of the outer rotor 12*a* integrally therewith, at positions that are separated from each other in the circumferential direction. Each protruding portion 9 is provided such that a protruding end portion thereof is slidable along the outer circumferential surface of the inner rotor 3 with a seal member 9*a* therebetween.

Fluid pressure chambers 5 are formed between the housing 12 and the inner rotor 3. In particular, in the present embodiment, four fluid pressure chambers 5 are formed between the protruding portions 9 that are adjacent to each other in the circumferential direction and between the outer rotor 12*a* and the inner rotor 3. The coupling bolts 12*d* are respectively inserted through the protruding portions 9, by which the outer rotor 12*a*, the front plate 12*b*, and the rear plate 12*c* are fixed to each other and are integrated into one piece.

A plurality of partitioning portions 6 (four in the present embodiment) that protrude outward in the radial direction are formed on the outer circumference side of the inner rotor 3, at positions that respectively face the fluid pressure chambers 5 and are separated from each other in the circumferential direction. Each partitioning portion 6 is provided such that a protruding end portion thereof is slidable along the inner circumferential surface of the outer rotor 1*a* with a seal member 6*a* therebetween. Each fluid pressure chamber 5 is partitioned by the corresponding partitioning portion 6 into an advancing chamber 5*a* and a retarding chamber 5*b* that are adjacent to each other in the rotation direction.

In the inner rotor 3, advancing channels 11*a* that are in communication with the advancing chambers 5*a*, and retarding channels 11*b* that are in communication with the retarding chambers 5*b*, are formed to be in communication with the inner circumference side, specifically the recessed portion 8, of the inner rotor 3. The advancing channels 11*a* are in communication with the recessed portion 8 at positions that are on the rear plate 12*c* side and that face a space between a fixed shaft portion 4 described below and the bottom plate portion 8*b*, and the retarding channels 11*b* are in communication with the recessed portion 8 at positions that are on the front plate 12*b* side and that face the outer circumferential surface of the fixed shaft portion 4.

In the present embodiment, the fixed shaft portion 4 functions as a fixed supporting portion by which the inner circumference side of the inner rotor 3 is rotatably supported coaxially with the housing 12. Fluid channels 19 that can be in communication with the advancing channels 11*a* and the retarding channels 11 b are provided in the fixed shaft portion 4. The fluid channels 19 include an advance-side supply channel 19*a* that can be in communication with the advancing channels 11 a and a retard-side supply channel 19*b* that can be in communication with the retarding channels 11*b*. The advance-side supply channel 19*a* is in communication with the space between the fixed shaft portion 4 and the bottom plate portion 8*b* from one end side of the fixed shaft portion 4 in the axial direction thereof, and the retard-side supply channel 19*b* is in communication with a ring-shaped circumferential groove 13 that is formed in the outer circumferential surface of the fixed shaft portion 4. Seal rings 14 that fill the gap between the outer circumferential surface of the fixed shaft portion 4 and the inner circumferential surface of the recessed portion 8 are attached to both sides of the ring-shaped circumferential groove 13 and one end side of the fixed shaft portion 4 in the axial direction.

A lock mechanism 15 that switches to a locked state in which the lock mechanism 15 restrains the rotation phase of the inner rotor 3 relative to the housing 12 at the maximum retard position, and to an unlocked state in which the lock mechanism 15 releases the restraint, is provided to span the inner rotor 3 and the housing 12. The lock mechanism 15 is configured by attaching a lock member 15*a* to one of the partitioning portions 6 of the inner rotor 3, the lock member 15*a* having a tip portion that can protrude and retract in the direction along the rotational axis X relative to a recessed portion (not shown in the drawings) formed in the rear plate 12*c*. The lock mechanism 15 switches to the locked state upon the tip portion of the lock member 15*a* becoming embedded in the recessed portion due to the biasing force of a biasing member (not shown in the drawings) such as a compression spring, and switches to the unlocked state upon the tip portion exiting the recessed portion toward the inner rotor 3 side, moving against the biasing force of the biasing member, due to the pressure of the hydraulic oil (fluid pressure).

Figure 3:
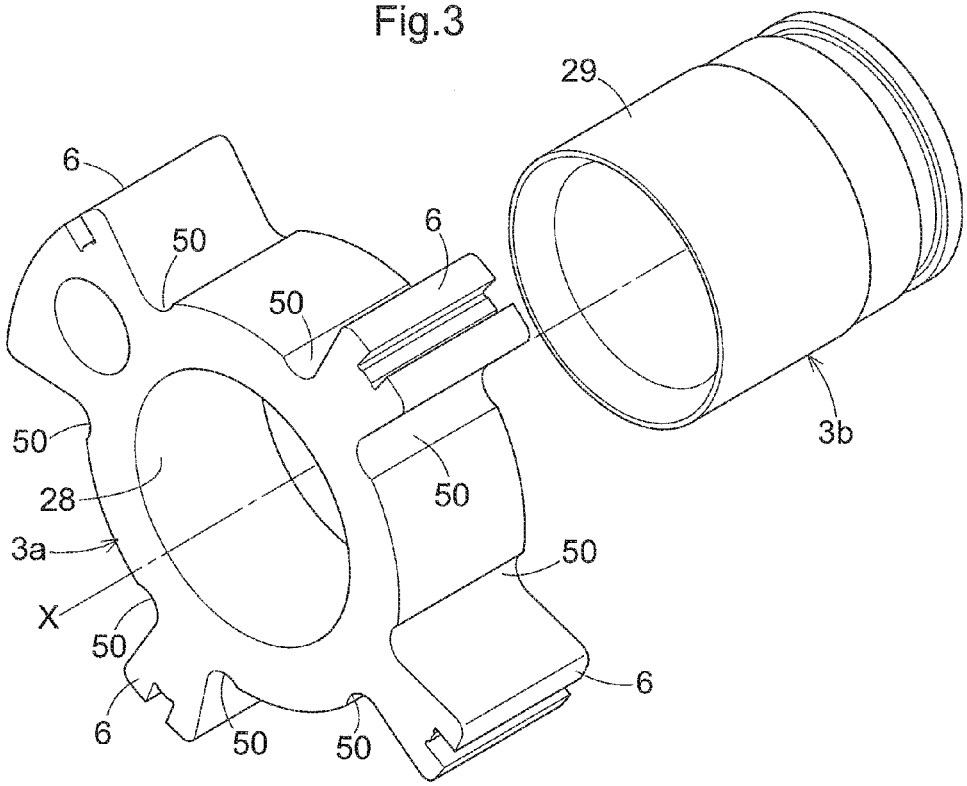
FIG. 3 is a diagram showing a first member and a second member.

The inner rotor 3 is formed to have a first member 3*a* and a second member 3*b*. As shown in FIG. 3, the first member 3*a* is configured with a cylindrical member that is provided with partitioning portions 6 and is made of an aluminum-based material such as an aluminum alloy. The second member 3*b* is provided coaxially with the first member 3*a* around the rotational axis X, and is configured with a cylindrical member that has a portion that overlaps the inner side of the first member 3*a* at least in the radial direction of the first member 3*a*, out of the radial direction and the axial direction of the first member 3*a*. In the present embodiment, the second member 3*b* is disposed on the inner side of the first member 3*a* in the radial direction. Therefore, the first member 3*a* and the second member 3*b* overlap each other in the radial direction. This second member 3*b* is configured with an iron-based material such as an iron-based sintered material. The first member 3*a* and the second member 3*b* are coaxially formed around the rotational axis X, and are integrated into one piece. The above-described recessed portion 8 is formed in the second member 3*b*, and the camshaft 101 and the second member 3*b* are fastened to each other with a bolt 10.

Figure 4:
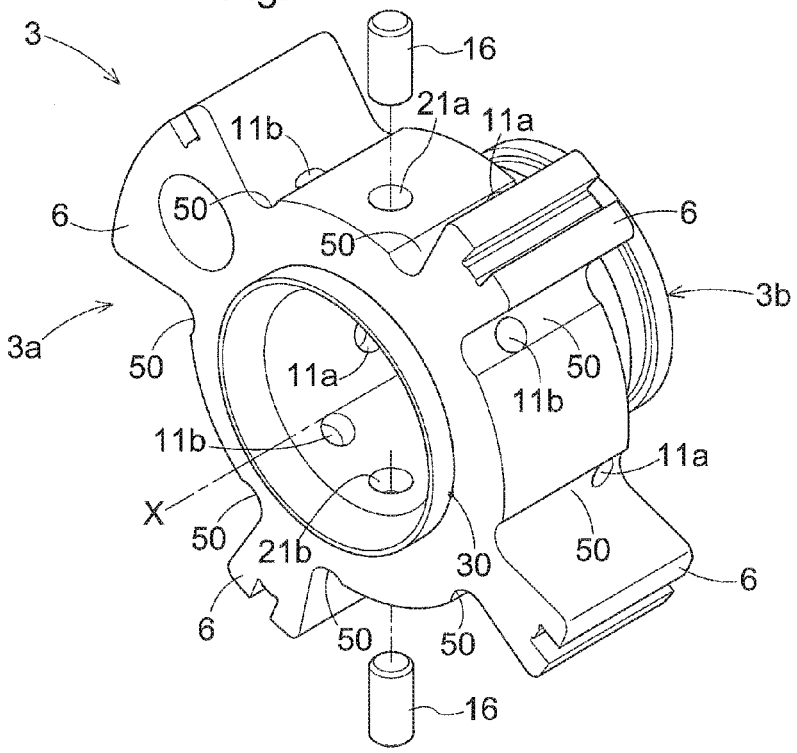
FIG. 4 is a diagram showing a driven rotating body that has been subjected to boring processing after the first member and the second member have been attached to each other to be integrated into one piece.

In the present embodiment, the first member 3*a* and the second member 3*b* are fitted to each other by being pressed from the direction along the rotational axis X, and are engaged with each other in the direction around the rotational axis X by two cylindrical rotation stopper pins 16 that are located at positions that are opposite in the radial direction, and that are made of solid steel. The rotation stopper pins 16 are fitted into a fitting hole 21*a*, which is formed through the first member 3*a*, and a fitting hole 21*b*, which is formed through the second member 3*b*, so as to be unremovable, by being pressed from a direction that is orthogonal to the rotational axis X such that their respective flat end surfaces 16*a* face the ring-shaped circumferential groove 13. After the first member 3*a* and the second member 3*b* are fitted to each other as shown in FIG. 4, the fitting holes 21 a and 21 b are formed by boring using a boring tool such as a drill A. The first member 3*a* and the second member 3*b* may be engaged with each other in the direction around the rotational axis X by one rotation stopper pin 16.

The phase control unit 7 controls the rotation phase of the inner rotor 3 relative to the housing 12 by controlling supply/discharge of pressurized fluid that circulates through the advancing channels 11 a and the retarding channels 11*b*. As shown in FIG. 2, the phase control unit 7 includes: an oil pump P that sucks/discharges hydraulic oil within an oil pan 17; a fluid control valve OCV that supplies/discharges hydraulic oil to/from the advance-side supply channel 19*a* and the retard-side supply channel 19*b*, and interrupts the supply/discharge of hydraulic oil; and an electronic control unit ECU that controls the actions of the fluid control valve OCV.

As shown in FIG. 1, the rotation phase of the inner rotor 3 relative to the housing 12 is displaced in the advance direction (the direction of increasing the capacity of the advancing chambers 5*a*) indicated by the arrow S1, or in the retard direction (the direction of increasing the capacity of the retarding chambers 5*b*) indicated by the arrow S2 by a hydraulic oil supplying/discharging operation of the phase control unit 7, and the rotation phase is maintained at a given phase by a hydraulic oil supply/discharge interrupting operation. Note that the lock mechanism 15 switches from the locked state to the unlocked state in response to an operation to supply hydraulic oil to the advancing chambers 5*a*.

As described above, the inner rotor 3 includes: the cylindrical first member 3*a* that is made of a lightweight aluminum-based material such as an aluminum alloy, and that is formed integrally with the partitioning portions 6 provided on the outer circumference side thereof; and the bottomed cylindrical second member 3*b* that is made of a high-strength iron-based material such as an iron-based sintered material, and that constitutes a part closer to the inner circumference side than the first member 3*a* is, the first member 3*a* and the second member 3*b* being coaxial with the rotational axis X and being integrated into one piece. The second member 3*b* can be configured with a sintered or forged article made of an iron-based material.

The first member 3*a* is provided with a cylindrical inner circumferential surface 28, and the second member 3*b* has a cylindrical outer circumferential surface 29 that is fitted into the inner circumferential surface 28. The recessed portion 8 is formed in the second member 3*b*, and the second member 3*b* and the camshaft 101 are fastened to each other with the bolt 10 and are integrated into one piece.

In the inner rotor 3, the outer circumference side of the second member 3*b* is enveloped using insert casting with an aluminum-based material with which the first member 3*a* is configured, and thus the inner circumferential surface 28 of the first member 3*a* and the outer circumferential surface 29 of the second member 3*b* are joined to each other coaxially with the rotational axis X, in the state of being prevented from rotating.

As shown in FIG. 4, the advancing channels 11*a* and the retarding channels 11*b* are formed to penetrate through a boundary 30 between the first member 3*a* and the second member 3*b* after the first member 3*a* and the second member 3*b* have been installed. Note that "after the first member 3*a* and the second member 3*b* have been installed" means "after enveloping the outer circumference side of the second member 3*b* in the first member 3*a* using insert casting as described above, and joining the first member 3*a* and the second member 3*b* to each other coaxially with the rotational axis X". The boundary 30 between the first member 3*a* and the second member 3*b* is equivalent to the boundary between the inner circumferential surface 28 of the first member 3*a* and the outer circumferential surface 29 of the second member 3*b*. The advancing channels 11*a* and the retarding channels 11*b* are formed to penetrate through this boundary 30. Note that "install" related to "after . . . have been installed" above does not necessarily mean "enveloping using insert casting", and may be fastening by "press fitting", "insertion", "casting in a mold", "screwing", "welding", and the like.

Figure 5:
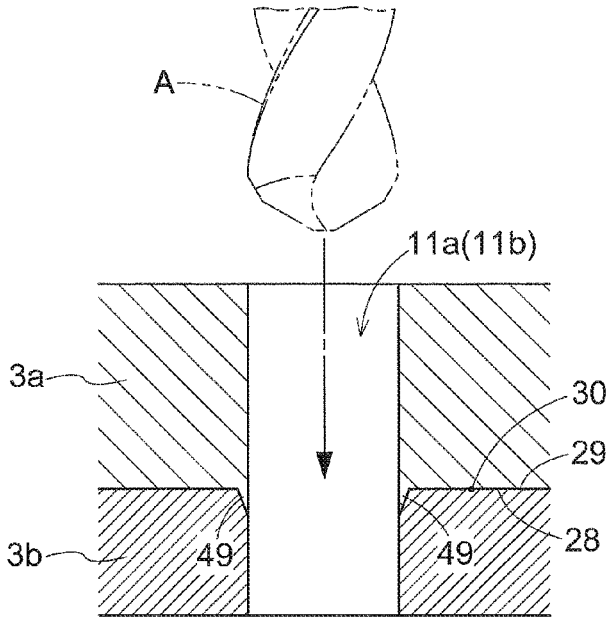
FIG. 5 is a diagram showing an intrusive portion that is formed at a boundary between the first member and the second member.

In the present embodiment, the first member 3*a* and the second member 3*b* overlap each other in the radial direction as described above. Therefore, as shown in FIG. 5, the advancing channels 11*a* and the retarding channels 11*b* are formed to penetrate, by boring processing using the drill A, performed from the outside of the first member 3*a* in the radial direction. Here, in the present embodiment, the first member 3*a* is configured with an aluminum-based material, and the second member 3*b* is configured with an iron-based material. In the present embodiment, boring processing on the first member 3*a* and the second member 3*b* is performed in one process. Therefore, in the present embodiment, boring processing on the first member 3*a* and the second member 3*b* is performed with the drill A that is suited to iron-based materials, and the rotation speed and the boring speed of the drill A is set to be suited to iron-based materials.

The first member 3*a* can be formed to have an intrusive portion 49 that intrudes into the second member 3*b* from the boundary 30 when the part on which the boring processing has been performed is seen in a direction that intersects the travelling direction of the drill A, as shown in FIG. 5. Consequently, a burr protrusion of the first member 3*a* enters into the second member 3*b* side, and the strength of the connection at the advancing channels 11*a* and the retarding channels 11*b* can be reinforced. Therefore, it is possible to prevent hydraulic oil in the advancing channels 11*a* and the retarding channels 11*b* from leaking from the boundary 30.

It is preferable that the fitting hole 21*a* of the first member 3*a* and the fitting hole 21*b* of the second member 3*b*, through which the rotation stopper pins 16 are to be inserted, are formed by boring processing in a single process in the same manner as the advancing channels 11*a* and the retarding channels 11*b*, before the advancing channels 11*a* and the retarding channels 11*b* are integrally formed, and after the first member 3*a* and the second member 3*b* are fitted to each other by being pressed from the direction along the rotational axis X. This configuration makes it possible to perform boring processing to form the advancing channels 11*a* and the retarding channels 11*b* in the state where relative rotation about the rotational axis X is restricted by the rotation stopper pins 16 inserted into the respective fitting holes 21*a* and 21*b* of the first member 3*a* and the second member 3*b*. Therefore, it is possible to form the advancing channels 11*a* and the retarding channels 11*b* that are each continuous between the first member 3*a* and the second member 3*b*, i.e., the advancing channels 11*a* and the retarding channels 11*b* serving as channels having a certain cross-sectional area.

In the present embodiment, the inner rotor 3 is configured by enveloping the outer circumference side of the second member 3*b* in the first member 3*a* using insert casting, and the first member 3*a* and the second member 3*b* are integrated into one piece, and then the advancing channels 11*a* and the retarding channels 11*b* are configured. Therefore, it is unnecessary to perform the positioning of the second member 3*b* relative to the first member 3*a* in advance. For this reason, it is possible to freely position the second member 3*b* relative to the first member 3*a*, and to save positioning work in the manufacturing process. Therefore, it is possible to simplify the processes, and to reduce the manufacturing cost.

Figure 6:
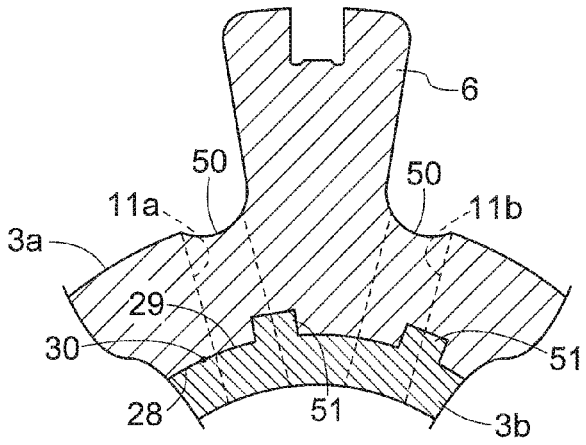
FIG. 6 is an enlarged view of an advancing channel and a retarding channel.
Figure 7:
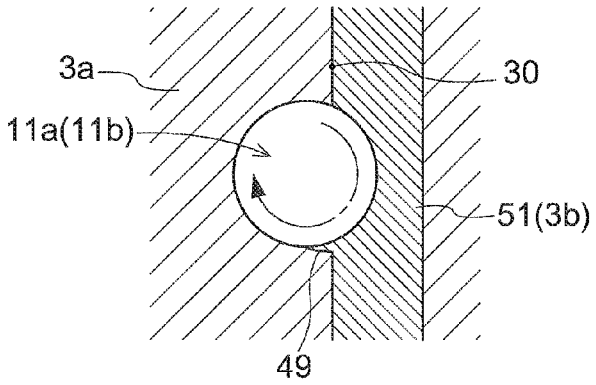
FIG. 7 is a view of a portion that has been subjected to boring processing, from an outside of an inner rotor in a radial direction.

FIG. 6 is an enlarged view of an advancing channel 11*a* and a retarding channel 11 b. FIG. 7 is a view of a portion that is to be subjected to boring processing for forming the advancing channel 11*a* (or the retarding channel 11*b*) shown in FIG. 6, seen from the outside of the inner rotor 3 in the radial direction. In the present embodiment, as shown in FIG. 6 and FIG. 7, the advancing channel 11*a* and the retarding channel 11*b* penetrate through the inner rotor 3 in the radial direction of the first member 3*a*, and are open to recessed portions 50 provided in the outer circumferential surface of the inner rotor 3. This configuration makes it possible to perform boring processing using the drill A after setting the drill A in a recessed portion 50, and to prevent axial misalignment from occurring due to the rotation of the drill A. Thus, it is possible to increase the degree of processing accuracy regarding the advancing channels 11*a* and the retarding channels 11*b*.

Also, it is preferable that protruding portions 51 that protrude in the radial direction are formed on the outer circumferential surface of the second member 3*b*, and portions of the protruding portions 51 are cut away using the drill A when boring processing for forming the advancing channels 11*a* and the retarding channels 11*b* is performed. By forming the advancing channels 11*a* and the retarding channels 11*b* in this way, it is possible to form the advancing channels 11*a* and the retarding channels 11*b* each having the intrusive portion 49 where the second member 3*b* intrudes into the first member 3*a* from the boundary 30. Note that although the protruding portions 51 shown each have the shape of a strip that extends in the axial direction of the second member 3*b*, the protruding portions 51 may each have the shape of a column that extends in the radial direction from the outer circumferential surface of the second member 3*b*.

[Other Embodiments]

Figure 8:
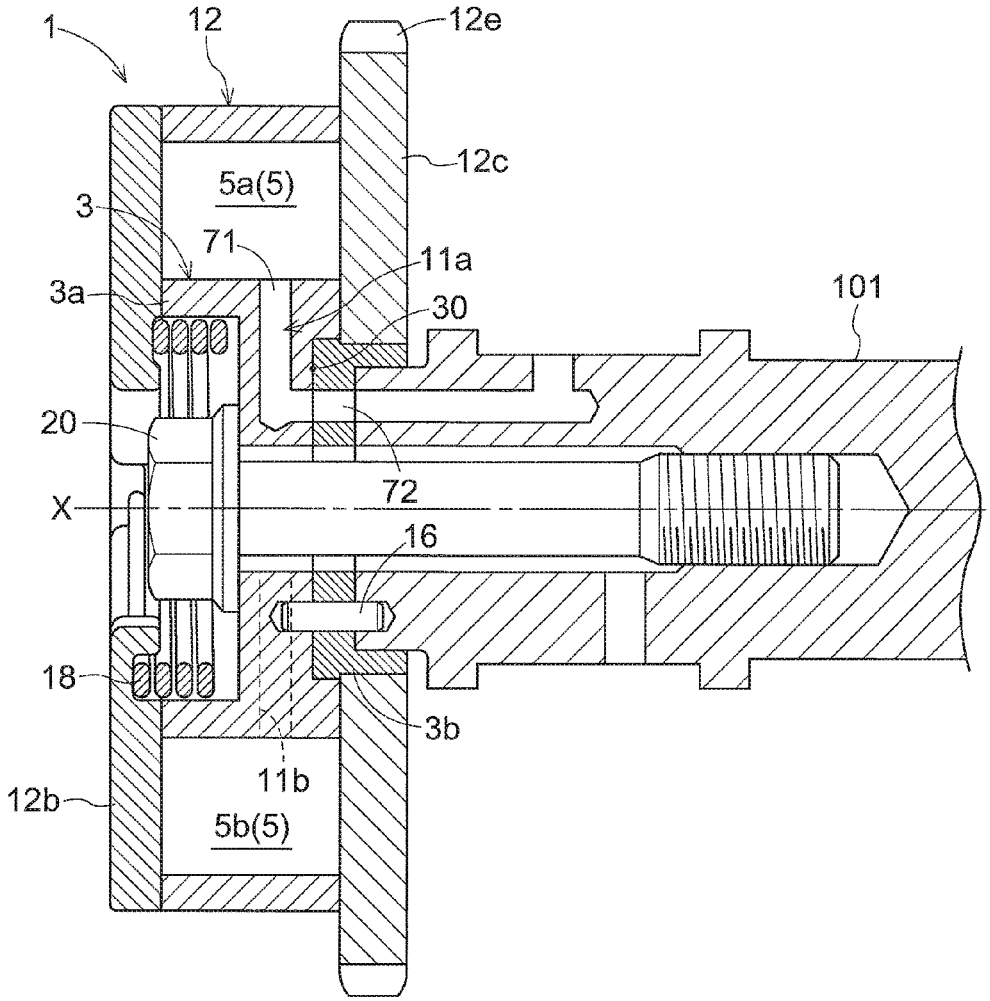
FIG. 8 is a diagram showing a portion of a valve opening/closing timing control device according to another embodiment.

In the above-described embodiment, the inner rotor 3 is formed such that the second member 3*b* has a portion that overlaps the first member 3*a* in the radial direction of the first member 3*a*. However, the inner rotor 3 may be formed such that the second member 3*b* has a portion that overlaps the first member 3*a* in the axial direction of the first member 3*a*. In such a case, at least the advancing channels 11*a* or the retarding channels 11*b* are configured to have a first part 71 and a second part 72. A cross-sectional view of such a valve opening/closing timing control device 1 is shown in FIG. 8.

The first part 71 is formed to extend along the radial direction of the first member 3*a*. Therefore, in the present embodiment, at least the advancing channels 11*a* or the retarding channels 11*b* are not provided to penetrate through the inner rotor 3 in the radial direction.

The second part 72 is formed to be in communication with the first part 71, and to extend along the axial direction of the first member 3*a* and the second member 3*b*. Therefore, in the present embodiment, the second part 72 is formed to be in communication with the first part 71 that is formed from an end surface of the second member 3*b* in the axial direction to the central portion side of the second member 3*b* in the axial direction. In other words, the second part 72 is formed to penetrate through the boundary 30 between the first member 3*a* and the second member 3*b*.

This second part 72 is formed by performing boring processing using the drill A after arranging the first member 3*a* and the second member 3*b* coaxially with the rotational axis X, in the same manner as in the first embodiment above. Therefore, it is possible to prevent misalignment from occurring between the first member 3*a* and the second member 3*b*.

Figure 9:
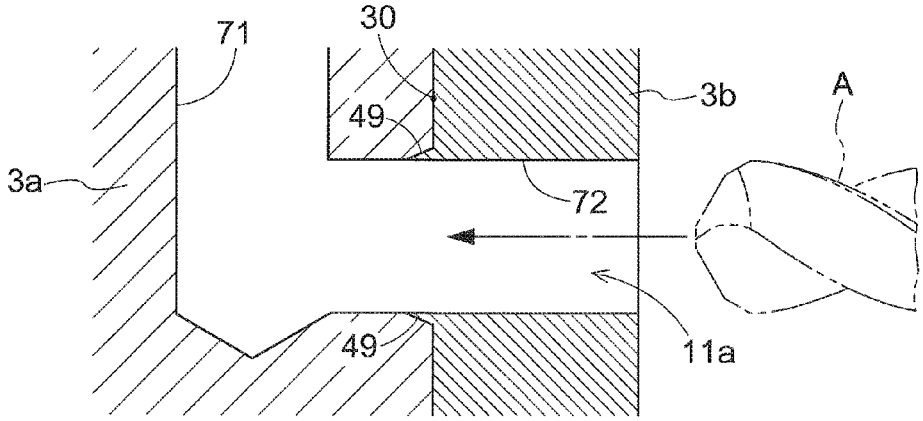
FIG. 9 shows an intrusive portion that is formed at a boundary between a first member and a second member of a valve opening/closing timing control device shown in FIG. 8.

Also, as shown in FIG. 9, it is possible to form the intrusive portion 49 where the second member 3*b* intrudes into the first member 3*a* from the boundary 30 between the first member 3*a* and the second member 3*b*. If this is the case, the intrusive portion 49 can be formed throughout the inner circumferential surface of the second part 72, and it is possible to prevent hydraulic oil from leaking from the boundary 30 between the first member 3*a* and the second member 3*b*.

In the above-described embodiment, the boring processing on the first member 3*a* and the second member 3*b* is performed using the drill A that is suited to the iron-based material with which the second member 3*b* is configured, and the rotation speed and the boring speed that are set to be suited to the iron-based material. However, the rotation speed and the boring speed may be set to be suited to the aluminum-based material with which the first member 3*a* is configured.

In the above-described embodiment, the advancing channels 11*a* and the retarding channels 11*b* each have the intrusive portion 49 formed at the boundary 30. However, depending on the conditions that have been set for boring processing, the advancing channels 11*a* and the retarding channels 11*b* may be configured so as not to have the intrusive portion 49.

INDUSTRIAL APPLICABILITY

The present invention is applicable to a valve opening/closing timing control device that includes: a driving rotating body that rotates in synchronization with a crankshaft of an internal combustion engine; and a driven rotating body that rotates in synchronization with a camshaft for opening/closing a valve of the internal combustion engine.

DESCRIPTION OF REFERENCE MARKS/NUMERALS

1: valve opening/closing timing control device
3: inner rotor (driven rotating body)
3*a*: first member
3*b*: second member
5: fluid pressure chamber
5*a*: advancing chamber
5*b*: retarding chamber
6: partitioning portion
7: phase control unit
11*a*: advancing channel
11*b*: retarding channel
12: housing (driving rotating body)
30: boundary
49: intrusive portion
50: recessed portion
71: first part
72: second part
101: camshaft
110: crankshaft
E: internal combustion engine
X: rotational axis

The invention claimed is:

1. A valve opening/closing timing control device, comprising:

a driving rotating body that rotates in synchronization with a crankshaft of an internal combustion engine;

a driven rotating body that is located on an inner circumference side of the driving rotating body coaxially with a rotational axis of the driving rotating body so as to be relatively rotatable, and that rotates in synchronization with a camshaft for opening/closing a valve of the internal combustion engine;

a fluid pressure chamber that is formed between the driving rotating body and the driven rotating body;

an advancing chamber and a retarding chamber that are formed by partitioning the fluid pressure chamber with a partitioning portion that is provided on an outer circumference side of the driven rotating body;

an advancing channel that is formed in the driven rotating body and is in communication with the advancing chamber;

a retarding channel that is formed in the driven rotating body and is in communication with the retarding chamber; and a phase control unit that controls a rotation phase of the driven rotating body relative to the driving rotating body by controlling supply and discharge of a pressurized fluid that circulates through the advancing channel and the retarding channel, wherein the driven rotating body has: a first member that is cylindrical and is provided with the partitioning portion; and a second member that is cylindrical, has a rotational axis that is the same as a rotational axis of the first member, and has a portion that overlaps an inner side of the first member at least in a radial direction of the first member, out of the radial direction of the first member and an axial direction, the advancing channel and the retarding channel are formed to penetrate through a boundary between the first member and the second member after the first member and the second member have been installed, and the advancing channel and the retarding channel are provided with an intrusive portion where the first member or the second member intrudes into the other of the first member and the second member from the boundary.

2. The valve opening/closing timing control device according to claim 1, wherein the advancing channel and the retarding channel penetrate through the driven rotating body in the radial direction of the first member, and are open to a recessed portion that is provided in an outer circumferential surface of the driven rotating body.

3. The valve opening/closing timing control device according to claim 1, wherein the second member overlaps the first member in the axial direction, at least the advancing channel or the retarding channel has: a first part that extends in the radial direction of the first member; and a second part that extends along the axial direction of the first member and the second member, and the first part and the second part are in communication with each other.

* * * * *